US007086609B2

(12) United States Patent
Wang

(10) Patent No.: US 7,086,609 B2
(45) Date of Patent: Aug. 8, 2006

(54) SWINGING LAWN SPRINKLER

(75) Inventor: Gary Wang, Ontario (CA)

(73) Assignee: Aquastar Industries Inc., Ontario (CA)

( * ) Notice: Subject to any disclaimer, the term of this patent is extended or adjusted under 35 U.S.C. 154(b) by 0 days.

(21) Appl. No.: 10/851,142

(22) Filed: May 24, 2004

(65) Prior Publication Data

US 2005/0194465 A1 Sep. 8, 2005

(30) Foreign Application Priority Data

Mar. 8, 2004 (TW) ..... 93203439 U

(51) Int. Cl.
*B05B 3/00* (2006.01)

(52) U.S. Cl. ..... 239/263.3; 239/232; 239/242; 239/281

(58) Field of Classification Search ..... 239/232, 239/251, 263, 263.3, 381, 555, 200–206, 239/533.14, 596, 233, 242

See application file for complete search history.

(56) References Cited

U.S. PATENT DOCUMENTS

| | | | | |
|---|---|---|---|---|
| 3,117,724 | A * | 1/1964 | Ray | 239/97 |
| 3,934,820 | A * | 1/1976 | Phaup | 239/205 |
| 4,568,024 | A * | 2/1986 | Hunter | 239/242 |
| 4,625,914 | A * | 12/1986 | Sexton et al. | 239/206 |

* cited by examiner

*Primary Examiner*—David A. Scherbel
*Assistant Examiner*—Jason Boeckmann
(74) *Attorney, Agent, or Firm*—Troxell Law Office, PLLC

(57) ABSTRACT

A swinging lawn sprinkler including a sprinkling control unit with a gear-operated transmission mechanism attached to one side of a sprinkler mount. A limiting connector having a water outlet connector engaged at one side is correspondingly matched to the gear-operated transmission mechanism and a spraying member. A main driving wheel, an adjusting seat, and a water inlet connector are sequentially coupled at the other end of the gear-operated transmission mechanism. The adjusting seat is equipped with a limiting cavity for a power switching device made up of a plurality of power units in linkage with a pivoting shaft and a pair of limiting zones with elastic pieces and pressure guide members adapted to be pivotally mounted to activate the shift of angles of a flow switch plate.

5 Claims, 8 Drawing Sheets

SWINGING LAWN SPRINKLER

BACKGROUND OF THE INVENTION

The present invention is related to a swinging lawn sprinkler, including a sprinkling control unit with a gear-operated transmission mechanism adapted therein attached to one side of a sprinkler mount thereof. A limiting connector having a water outlet connector engaged at one side is correspondingly matched to the gear-operated transmission mechanism and a spraying member. A main driving wheel, an adjusting seat, and a water inlet connector are sequentially coupled at the other end of the gear-operated transmission mechanism thereof. The adjusting seat thereof is equipped with a limiting cavity having locating guide blocks protruding thereon for a power switching device to be mounted therein to activate the shift of angles of a flow switch plate thereby. When the power switching device is rotated, power units of the power switching device will produce arc-shaped stress concentration in advance and store energy thereby till an auxiliary force is formed to send pressure guide members adapted at the power switching device therein instantaneously and quickly over to the other side of the locating guide blocks thereof, efficiently shortening the moving course of the pressure guide members and elastic pieces, and facilitating the swing of the spraying member within a short period of time so as to increase the frequency of the variation of water flow for more thorough and equal sprinkling of water around the lawn in a short time.

Please refer to FIGS. 1 to 4 inclusive. A conventional swinging lawn sprinkler includes a sprinkling mount 10, and a sprinkling control unit 11 having a gear-operated transmission mechanism 111 adapted therein to be attached to one side of the sprinkling mount 10 thereof. The sprinkling control unit 11 also has a limiting connector 112 fixed at one outer end thereof, and a water inlet connector 113 with a water control valve adapted therein joined at the other outer end thereof. The limiting connector 112 is correspondingly worked with the gear-operated transmission mechanism 111 and a spraying member (without shown in the diagram). The gear-operated transmission mechanism 111 is equipped with two pairs of symmetrical resilient plates 1111, 1112 protruding at one end thereof wherein one pair of the symmetrical resilient plates 1111 has a hooked flange 1111' protruding at the outer edge thereof respectively to be fixed to an annular facet 1132' of a sleeve hole 1131' of a water outlet connector 113', and the other pair of the symmetrical resilient plates 1112 has a protruding rib 1112' disposed at the outer periphery thereon respectively to be meshed with a serrated facet 1133' of the sleeve hole 1131' thereof as shown in FIG. 2. The other end of the gear-operated transmission mechanism 1111 is pivotally engaged with a rotary main driving wheel 114 to which an adjusting seat 115 having water inlet holes 1151 and pressure-relief vents disposed thereon is coupled at the other side thereof. A rotary device 116 with a locating member 117 joined therein is in sleeve engagement with the adjusting seat 115 thereof. The locating member 117 thereof has a pair of left and right water orifices 1171 symmetrically disposed at both upper and lower sides thereof respectively, matching to the water inlet holes 1151 of the adjusting seat 115 thereof as shown in FIG. 3. A pair of hooked springs 118 are symmetrically disposed at the left and right side of the locating member 117 thereof in linking cooperation with the rotary device 116 thereof as shown in FIG. 4.

There are some drawbacks to such conventional swinging lawn sprinkler. Most of all, when the sprinkling control unit 11 is switched to shift the angle of water discharge of the spraying member thereof as shown in FIG. 4, the rotary device 116 is moved in contrary direction with respect to the locating member 117 thereof, and the hooked springs 118 thereof is compressed before twisted and turned to the other side thereof to shift the angle of the spraying member thereof, which not only makes the switch of water flow rather complicated and inconvenient, but also prolongs the moving course of the hooked springs 118 thereof and increases the time required in the saving of the spraying member thereof. Thus, the frequency of the variation of water flow within a certain period of time is significantly reduced and much longer time is required so as to sprinkle water thoroughly around the lawn.

SUMMARY OF THE PRESENT INVENTION

It is, therefore, the primary purpose of the present invention to provide a swinging lawn sprinkler, including a sprinkling control unit with a gear-operated transmission mechanism adapted therein attached to one side of a sprinkler mount thereof, and a main driving wheel, an adjusting seat, and a water inlet connector are sequentially coupled at one side of the gear-operated transmission mechanism thereof wherein a power switching device is mounted to a limiting cavity of the adjusting seat; whereby, when the power switching device is rotated, power units of the power switching device will produce arc-shaped stress concentration in advance and store energy thereby till an auxiliary force is formed, overpowering elastic pieces so as to send pressure guide members adapted at the power switching device therein instantaneously and quickly over to the other side of locating guide blocks protruding at the limiting cavity thereof, efficiently shortening the moving course of the pressure guide members and the elastic pieces, and facilitating the swing of the spraying member within a short period of time so as to increase the frequency of the variation of water flow for more thorough and equal sprinkling of water around the lawn in a short time.

DETAILED DESCRIPTION OF THE PREFERRED EMBODIMENTS

Figure 1:
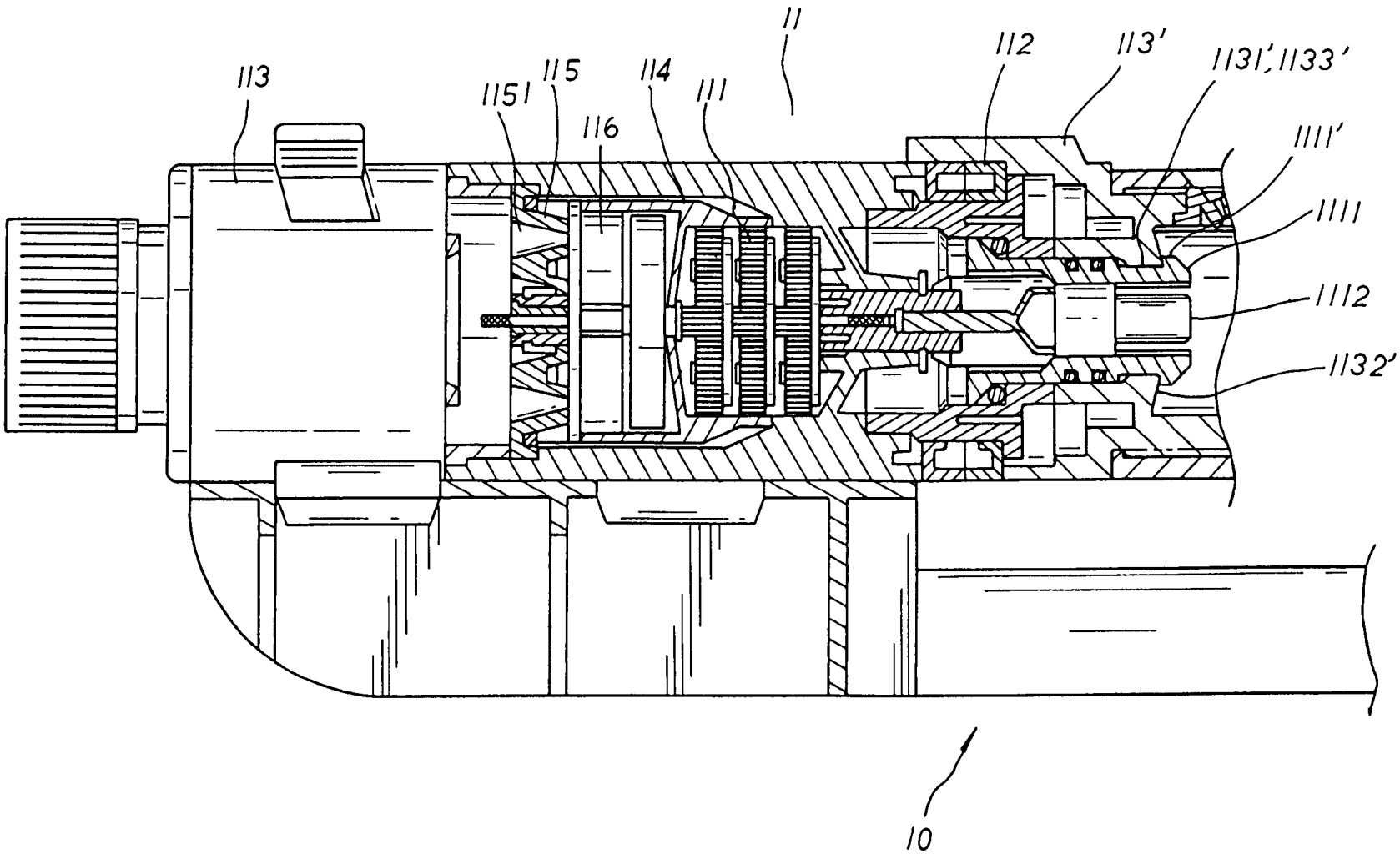
FIG. 1 PRIOR ART
FIG. 1 is a cross sectional view of a conventional swinging lawn sprinkler in assembly.
Figure 3:
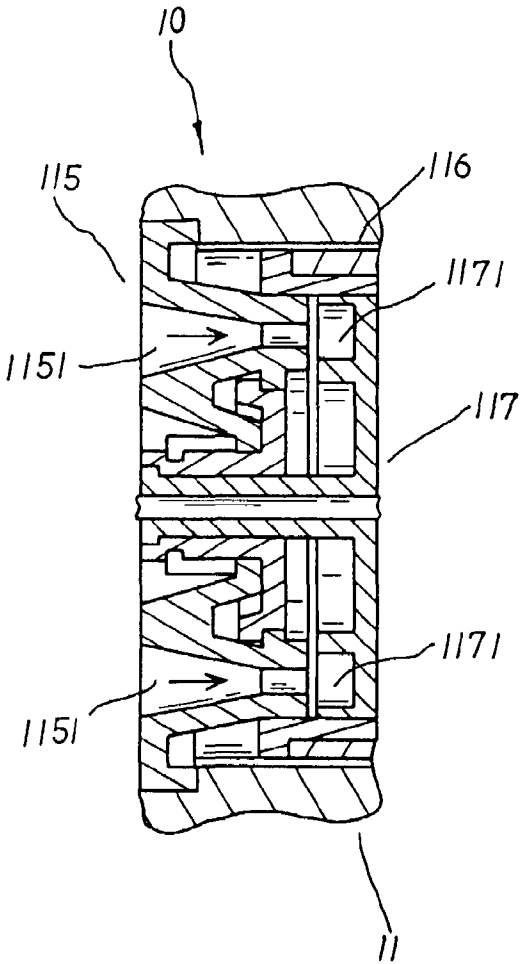
FIG. 3 PRIOR ART
FIG. 3 is a cross sectional diagram showing water flowing into an adjusting seat and a locating member of the conventional swinging lawn sprinkler thereof.
Figure 2:
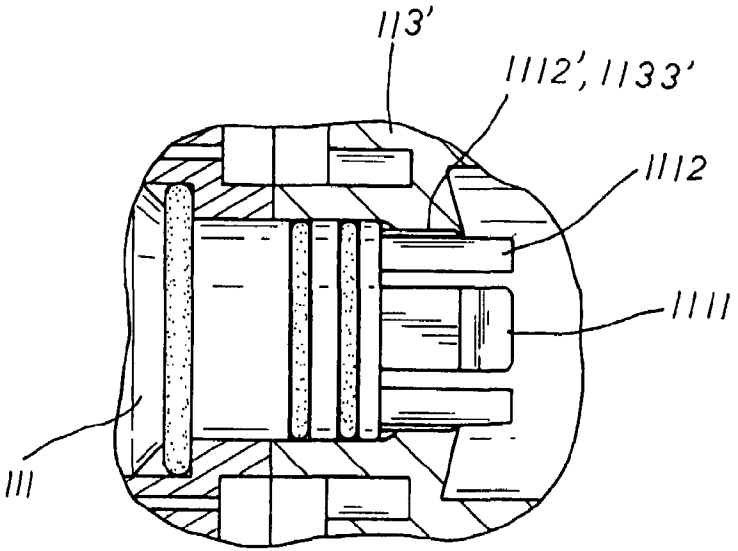
FIG. 2 PRIOR ART
FIG. 2 is a partially cross sectional view of a gear-operated transmission mechanism of the conventional swinging lawn sprinkler joined to a water outlet connector at one end thereof.
Figure 4:
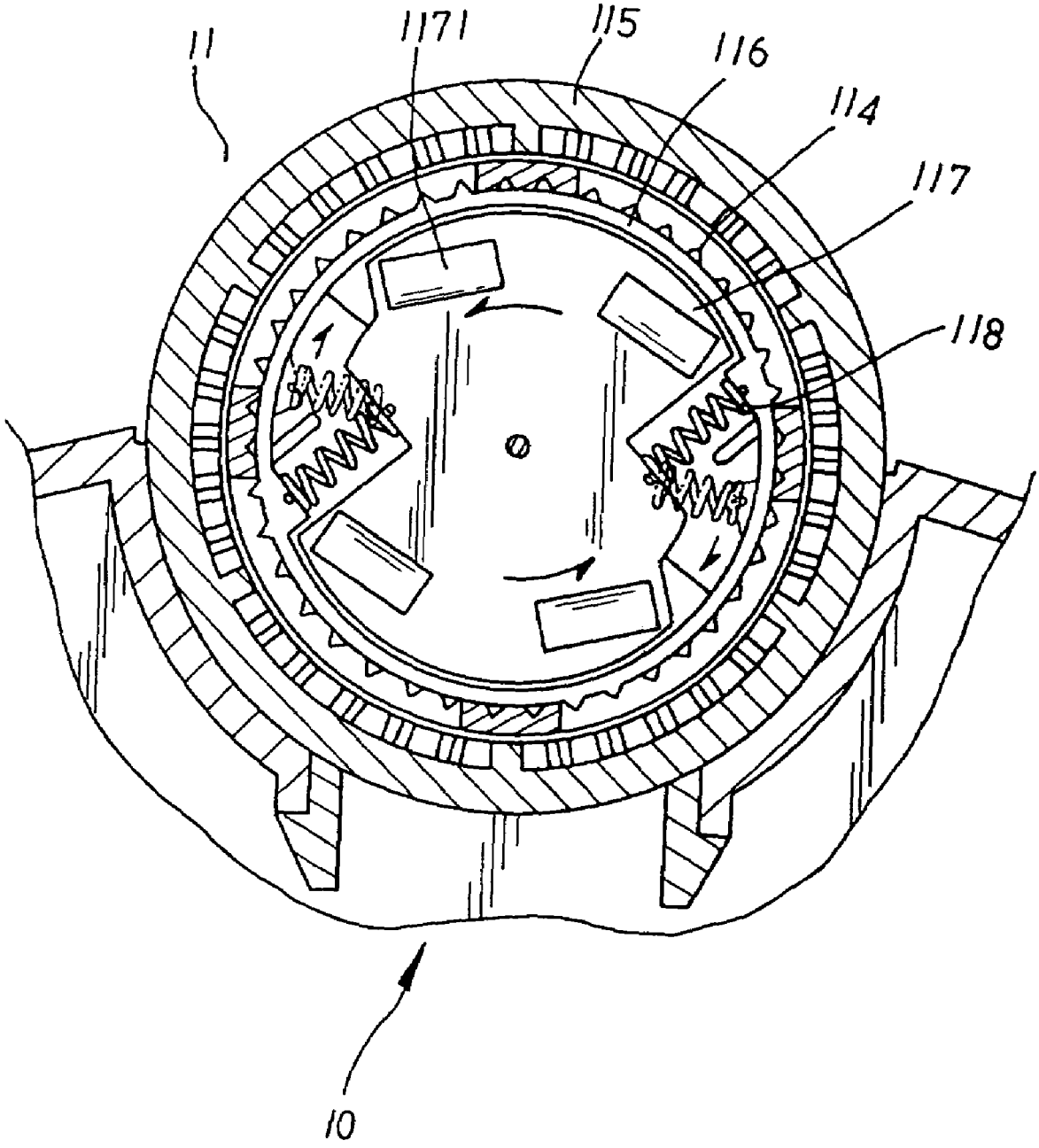
FIG. 4 PRIOR ART
FIG. 4 is a cross sectional diagram of a rotary device and the locating member of the conventional swinging lawn sprinkler switched in angles in practical use.
Figure 5:
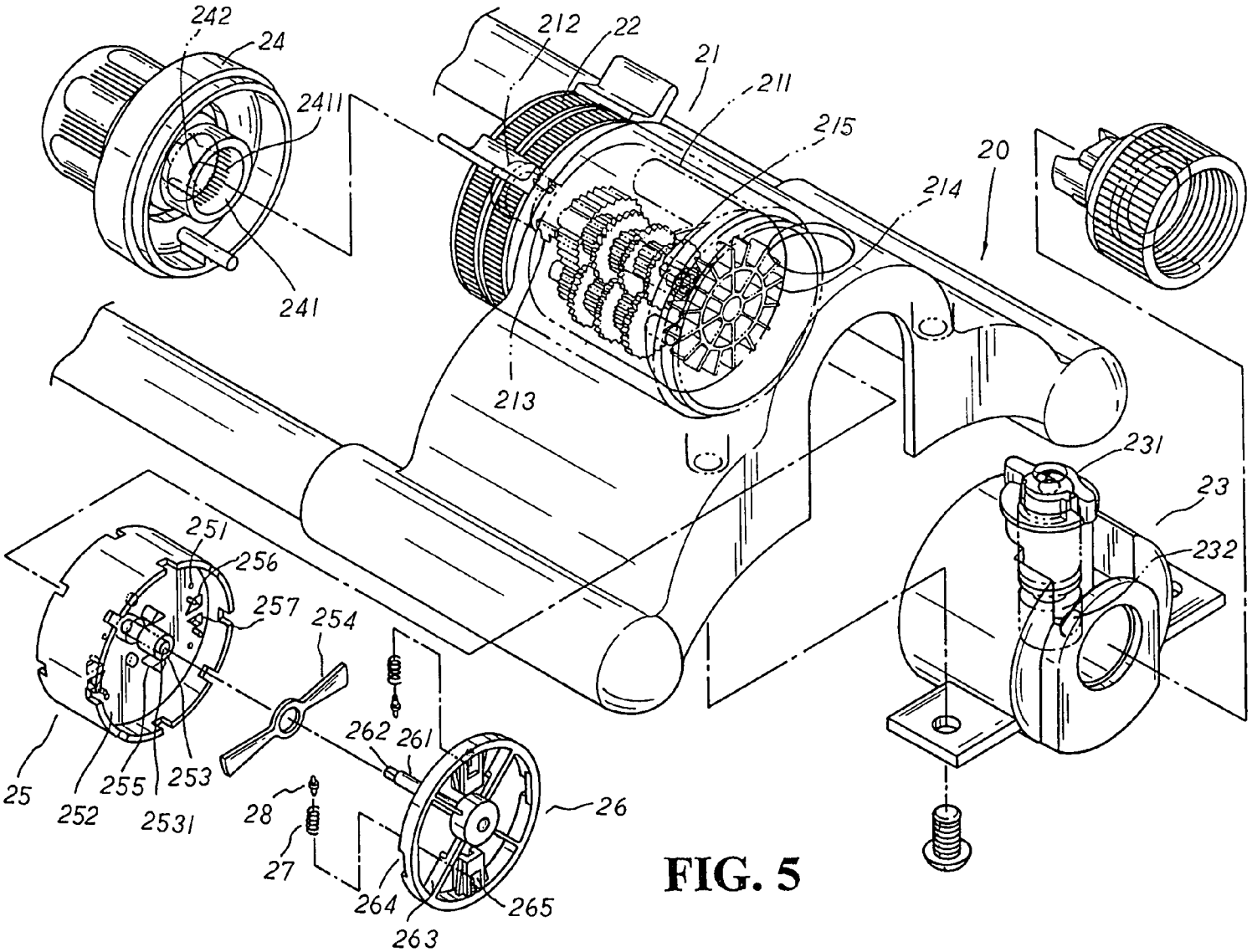
FIG. 5 is a perspective exploded view of the present invention.
Figure 6:
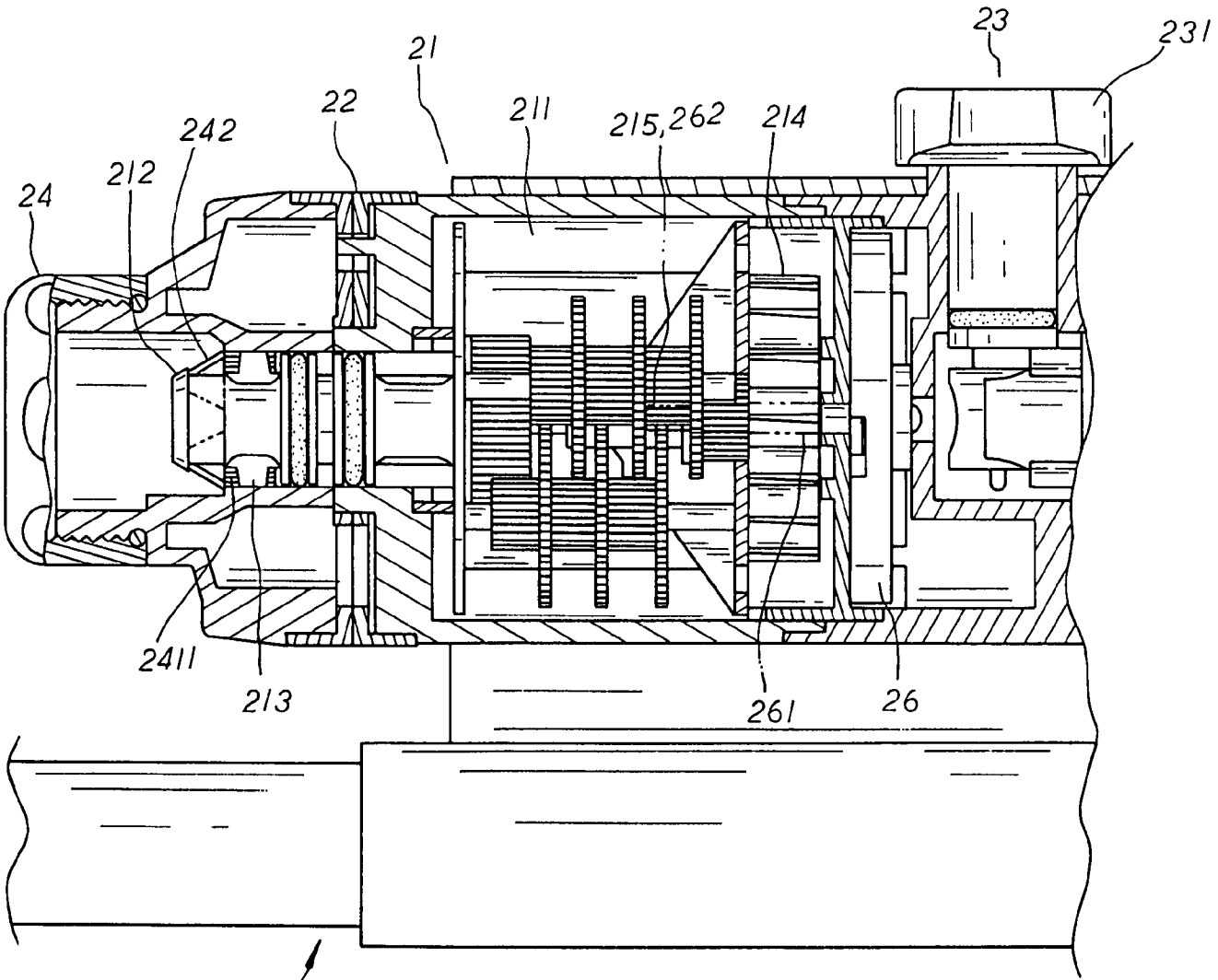
FIG. 6 is a cross sectional view of the present invention in assembly.

Please refer to FIGS. 5 and 6. The present invention is related to a swinging lawn sprinkler, including a sprinkler mount 20, and a sprinkling control unit 21 with a gear-operated transmission mechanism 211 adapted therein to be attached to one side of the sprinkler mount 20. The sprinkling control unit 21 also has a limiting connector 22 and a water outlet connector 24 sequentially joined at one outer end, and an water inlet connector 23 with a water control valve 231 adapted therein to be engaged at the other outer end thereof. The water control valve 231 having a water inlet hole 232 disposed at the inner side of the water inlet connector 23 is applied to control the amount of water flow, and the limiting connector 22 is correspondingly matched to the gear-operated transmission mechanism 211 and a spraying member (without shown in the diagram). The gear-operated transmission mechanism 211 is equipped with a tapered stop ring 212 protruding at one end thereof, and a pair of resilient wing panels 213 symmetrically disposed at the upper and lower periphery of the one end thereof to be meshed with an annular toothed surface 2411 defining a sleeve hole 241 of the water outlet connector 24 therein. The sleeve hole 241 of the water outlet connector 24 also has a plurality of sleeve plates 242 protruding at the front of the sleeve hole 241 thereof for the tapered stop ring 212 thereof to be abutted against in location thereby. At the other end of the gear-operated transmission mechanism 211 is disposed a squared coupling hole 215, and a rotary main driving wheel 214 pivotally engaged therewith to activate the gear-operated transmission mechanism 211 thereby. An adjusting seat 25 mounted to one side of the main driving wheel 214 is made up of a limiting cavity 252 with pressure-relief vents 251 concaved at one side thereof, and a coupling rod 253 with a pivoting hole 2531 protruding at the center of the limiting cavity 252 thereof for a flow switch plate 254 to be joined in sleeve engagement therewith. Triangular locating guide blocks 255 are symmetrically preset at the upper and lower surfaces of the limiting cavity 252 around the coupling rod 253 thereof, and two pairs of upper and lower water orifices 256, 257 are symmetrically arranged at the left and right surfaces of the limiting cavity 252 thereof around both sides of the coupling rod 253 thereof.

Figure 7:
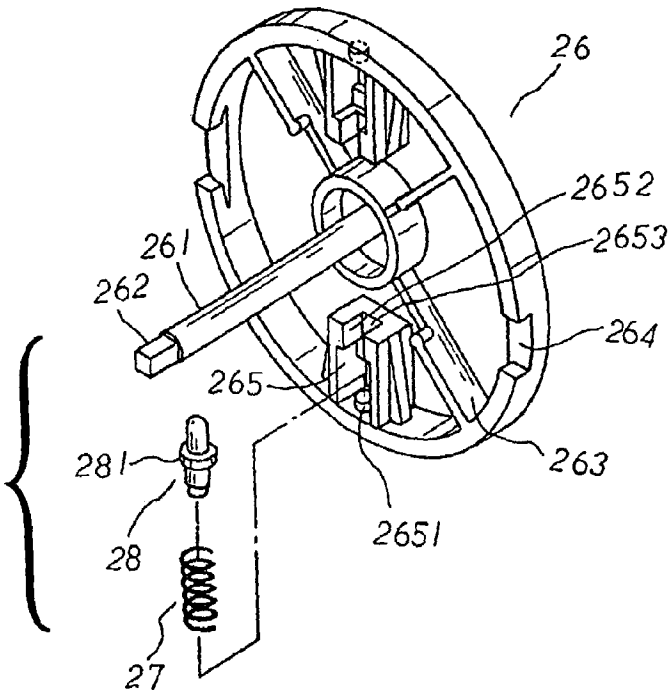
FIG. 7 is an enlarged and perspective exploded view of a power switching device, an elastic piece, and a pressure guide member of the present invention.

A power switching device 26 having a pivoting shaft 261 as shown in FIG. 7 is mounted to the pivoting hole 2531 of the adjusting seat 25. The pivoting shaft 261 of the power switching device 26 has a squared coupling end 262 disposed at one side to be securely engaged with the squared coupling hole 215 of the gear-operated transmission mechanism 211 thereby. The power switching device 26, which is formed of an annular frame body, has a plurality of power units 263 extending concentrically inwards at the inner side in linkage with the pivoting shaft 261 thereof, and two dented control sections 264 symmetrically cut at the corresponding lateral sides thereon for both ends of the flow switch plate 254 to be abutted against and limited in location thereby. Both ends of the flow switch plate 254 are respectively positioned to conceal alternatively one upper orifice 256 at one side and one lower orifice 257 at the other side thereof. The power switching device 26 also includes a pair of limiting zones 265 symmetrically protruding at the inner side therein, each having a locating protrusion 2651 disposed at the bottom side therein, and a pair of stop blocks 2652 correspondingly protruding at the upper inner wall thereon to define a smaller guiding space 2653 therebetween. An elastic piece 27 is adapted to the limiting zone 265 therein and mounted to the locating protrusion 2651 at one end thereof, and a pressure guide member 28 is joined to the other end of the elastic piece 27 thereof. The pressure guide member 28, defined by round arc columns at both ends thereof, is equipped with a stop ring 281 at the middle section thereof, which is resiliently supported by the elastic piece 27 to abut against the stop blocks 2652 of the limiting zone 265 thereby. The other end of the pressure guide member 28 thereof is led through the guiding space 2653 defined by the stop blocks 2652 thereof and extended outwards at the limiting zone 265 to abut against one corresponding side of the triangular locating guide block 255 thereof as shown in FIG. 8.

Figure 8:
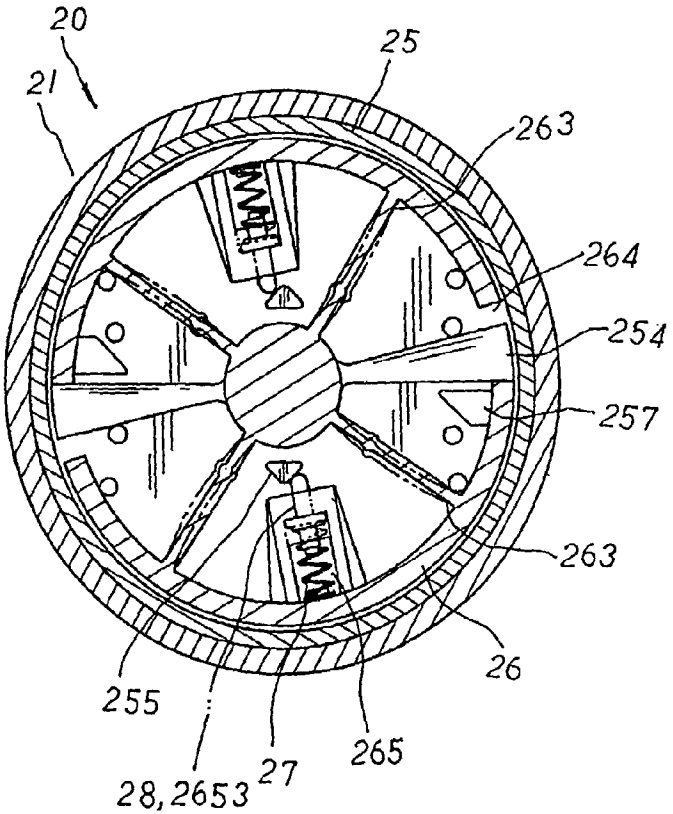
FIG. 8 is a cross section view of the power switching device mounted to the adjusting seat thereof with power units activated thereon in operation.
Figure 10:
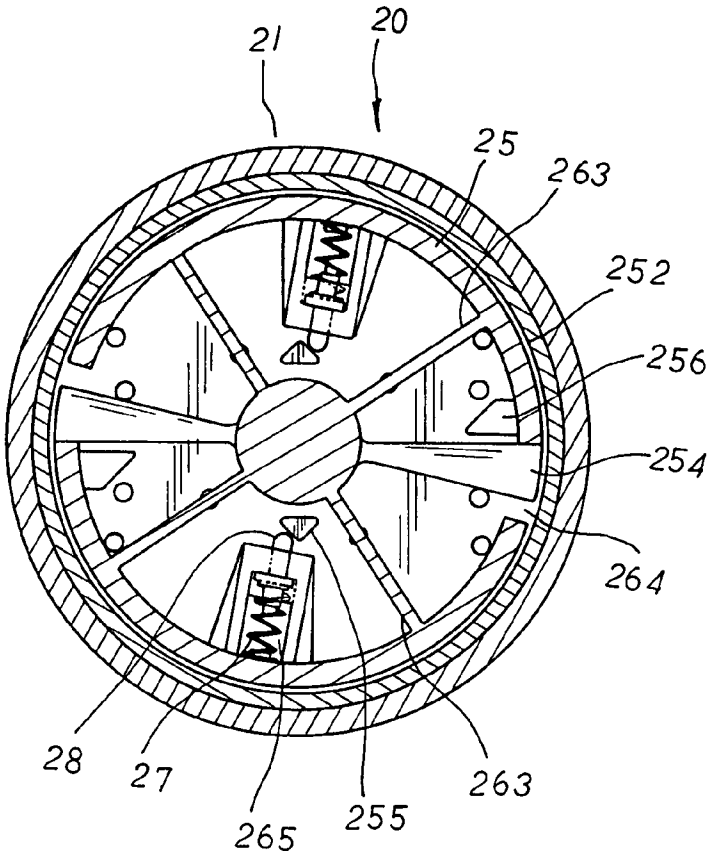
FIG. 10 is cross sectional view of the power switching device completed in the shift of position at the adjusting seat therein to switch the angle of a spraying member of the present invention.
Figure 9:
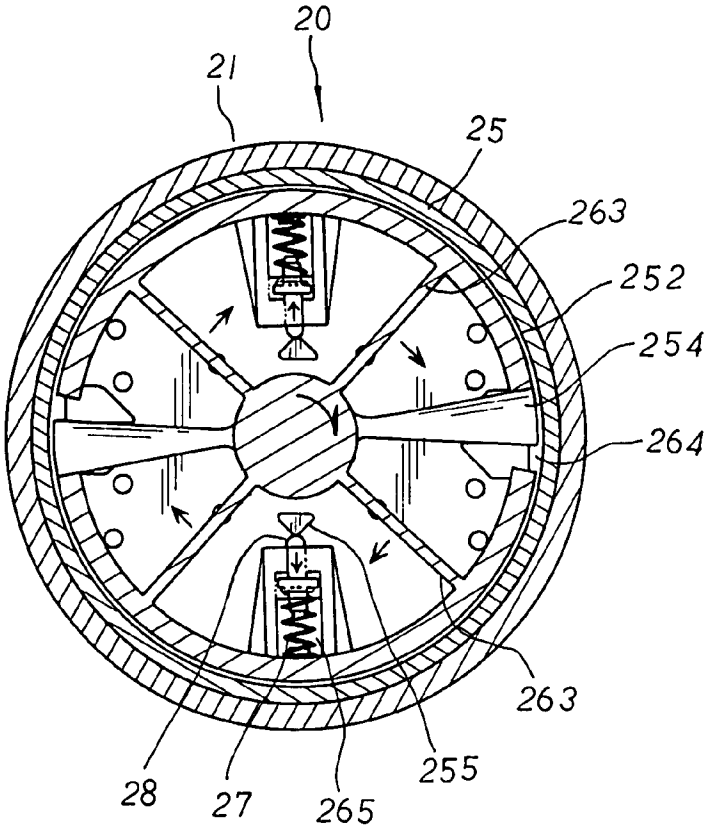
FIG. 9 is a cross sectional view of the power switching device and the pressure guide members thereof shifted in angles at the adjusting seat therein.

Please refer to FIGS. 8 to 10 inclusive. The current of water flowing into the water control valve 231 of the water inlet connector 23 via the water inlet hole 232 thereof and going out through the upper and lower water orifices 256, 257 unconcealed by the flow switch plate 254 will activate the main driving wheel 214 to rotate in one direction, triggering the movement of the gear-operated transmission mechanism 211 which in turn will actuate the spraying member (without shown in the diagram) to sprinkle water while swinging to one side therewith. And the spraying member thereof is swung to and fro within a range adjusted by the limiting connector 22 thereof. To swing the spraying member backwards to the other direction after going to the extreme defined by the limiting connector 22, the power switching device 26 will rotate along the limiting cavity 252 at the adjusting seat 25 therein, and the power units 263 will produce arc-shaped stress concentration in advance to store energy thereby till the elastic pieces 27 are overpowered by the power units 263 thereof, instantaneously forming an auxiliary force to lead the pressure guide members 28 along to the bottommost tip of the locating guide blocks 255 thereof and compress vertically the elastic pieces 27 simultaneously as shown in FIG. 9. Thus, the pressure guide members 28 are instantaneously sent over to the other side of the locating guide blocks 255 thereof, efficiently shortening the moving course of the pressure guide members 28 and the elastic pieces 27 thereof, and resulting in the rotating movement of the power switching device 26 therewith. Meanwhile, the flow switch plate 254 is rotated to one side therewith via the guidance of the dented control sections 264 thereof, precisely sealing up the previous upper and lower water orifices 256, 257 as shown in FIG. 10 for water current to come out through another pair of the upper and lower water orifices 256, 257. The water flow guided to come out in another angle will activate the main driving wheel 214 and the gear-operated transmission mechanism 211 as well to rotate in another direction therewith. Thus, via the auxiliary force produced by the rotating power units 263 of the power switching device 26 overpowering the elastic pieces 27 to send the pressure guide members 28 instantaneously over to the other side of the locating guide blocks 255 thereof, the moving course of the pressure guide members 28 and the elastic pieces 27 is efficiently shortened, facilitating the swing of the spray member within a short period of time so as to increase the frequency of the variation of water flow for more thorough and equal sprinkling of water around the lawn in a short time.

Figure 11:
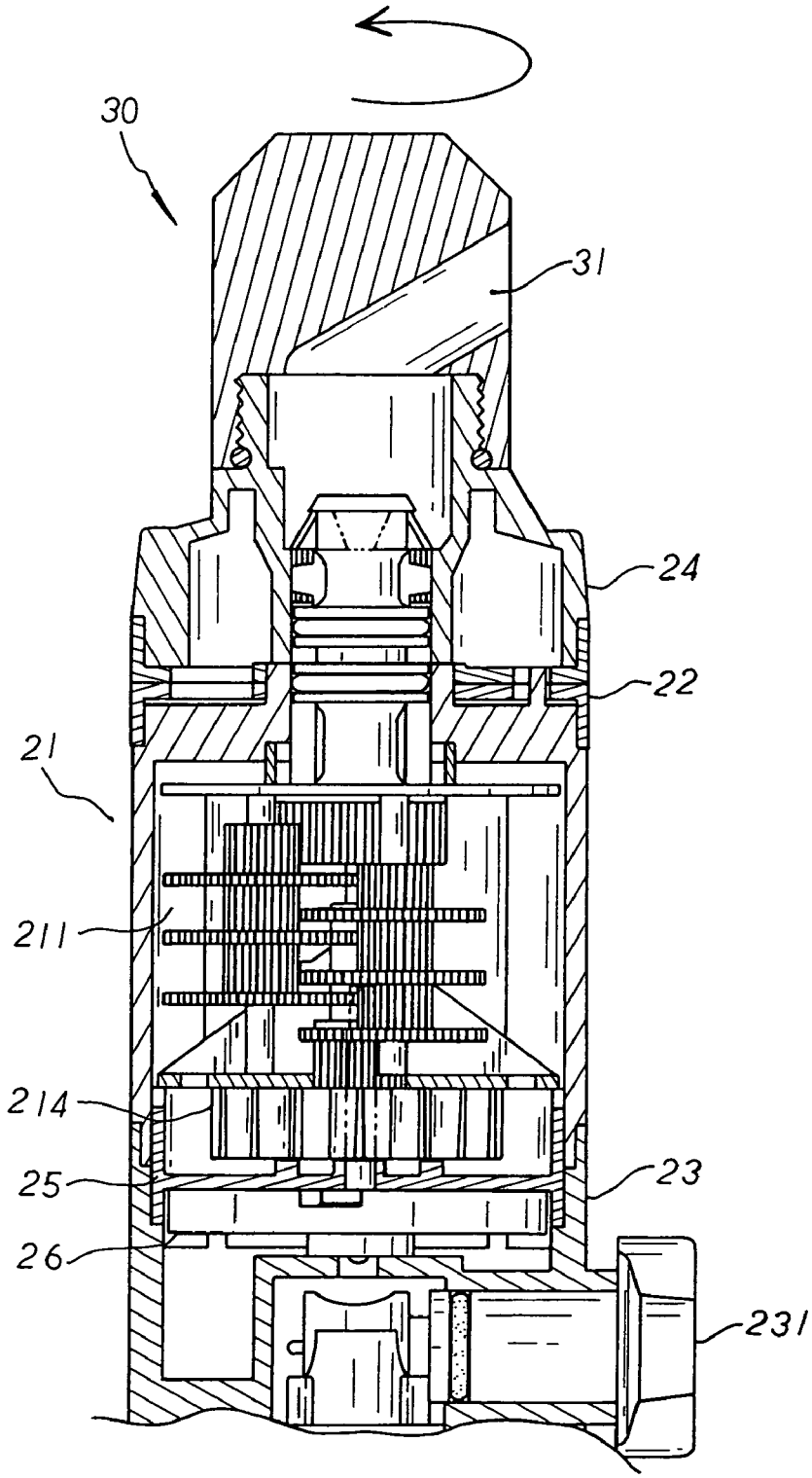
FIG. 11 is a cross sectional view of another embodiment of the present invention.

Please refer to FIG. 11 showing anther embodiment of the present invention. The sprinkling control unit 21 can also be assembled into a vertical type. A sprinkler body 30 having a water nozzle 31 disposed therein is mounted on top of the water outlet connector 24 wherein the sprinkler body 30 is vertically swung back and forth with the sprinkling control unit 21 thereof.

What is claimed is:

1. A swinging lawn sprinkler, including a sprinkling control unit made up of a gear-operated transmission mechanism, a limiting connector, a water inlet connector, a water outlet connector, a main driving wheel, and an adjusting seat;

the present invention being characterized by that, a power switching device is mounted to a limiting cavity of the adjusting seat to activate the shift of angles of a flow switch plate thereby, and is equipped with a plurality of power units extending radially inwards on an inner side in linkage with a rotating shaft thereof, and a pair of limiting zones symmetrically protruding on the inner side of the power switch device, each of the pair of limiting zones having an elastic piece and a pressure guide member located therein, wherein one end of the pressure guide member is supported by the elastic piece and extends inwards and abuts against one side of a triangular locating guide block located in the limiting cavity of the adjusting seat;

wherein when the power switching device is rotated, the power units will bend until an auxiliary force is produced, deforming the elastic pieces and moving each of the pressure guide members past an obstructing side of the locating guide block.

2. The swinging lawn sprinkler as claimed in claim 1 wherein the power switching device is formed of an annular frame body.

3. The swinging lawn sprinkler as claimed in claim 1 wherein each limiting zone of the power switching device thereof has a pair of stop blocks symmetrically protruding at the upper inner walls thereon to define a smaller guiding space there-between for one end of the pressure guide member to be led there-through.

4. The swinging lawn sprinkler as claimed in claim 1 wherein each of the pair of limiting zones of the power switching device has a locating protrusion, one elastic piece is located between each locating protrusion and each pressure guide member.

5. The swinging lawn sprinkler as claimed in claim 1 wherein each pressure guide member is provided with a stop ring disposed at the middle section thereof, resiliently supported by the elastic piece to abut against the stop blocks of the limiting zone of the power switching device thereby.

* * * * *